US011145226B2

(12) United States Patent
Ebling et al.

(10) Patent No.: US 11,145,226 B2
(45) Date of Patent: Oct. 12, 2021

(54) SIGN EDGE BUMPER ASSEMBLY

(71) Applicant: Retail Design Services, LLC, Northfield, MN (US)

(72) Inventors: Gary Robert Ebling, Northfield, MN (US); John Robert Ebling, Northfield, MN (US)

(73) Assignee: RETAIL DESIGN SERVICES, LLC, Northfield, MN (US)

( * ) Notice: Subject to any disclaimer, the term of this patent is extended or adjusted under 35 U.S.C. 154(b) by 68 days.

(21) Appl. No.: 16/613,220

(22) PCT Filed: May 23, 2019

(86) PCT No.: PCT/US2019/033673
§ 371 (c)(1),
(2) Date: Nov. 13, 2019

(87) PCT Pub. No.: WO2019/236310
PCT Pub. Date: Dec. 12, 2019

(65) Prior Publication Data

US 2021/0097899 A1 Apr. 1, 2021

Related U.S. Application Data

(60) Provisional application No. 62/680,060, filed on Jun. 4, 2018.

(51) Int. Cl.
*G09F 15/00* (2006.01)
*G09F 7/18* (2006.01)

(52) U.S. Cl.
CPC ..... *G09F 7/18* (2013.01); *G09F 15/005* (2013.01); *G09F 15/0012* (2013.01);
(Continued)

(58) Field of Classification Search
CPC ..... G09F 7/18; G09F 15/0012; G09F 15/005; G09F 15/0037; G09F 2007/1826;
(Continued)

(56) References Cited

U.S. PATENT DOCUMENTS 1,761,233 A 6/1930 De Forest
1,888,246 A * 11/1932 Sprung ..... G09F 7/18 40/607.11

(Continued)

FOREIGN PATENT DOCUMENTS

GB 1516625 7/1978
JP 2002021027 A * 1/2002

OTHER PUBLICATIONS

International Search Report and Written Opinion from corresponding International Application No. PCT/US2019/033673, dated Aug. 20, 2019 (15 pages).

*Primary Examiner* — Cassandra Davis
(74) *Attorney, Agent, or Firm* — Mai-Tram D. Lauer; Westman, Champlin & Koehler, P.A.

(57) ABSTRACT

An apparatus is configured to be used with a post-mountable sign. The apparatus includes identical first and second frame sections. Each of the first and second frame sections includes a first fastening element located at a first end thereof; a second fastening element located at a second end thereof; and a first recess between the first and second ends configured to accommodate the post. The first fastening element of the first frame section is configured to cooperate with the second fastening element of the second frame section. The first fastening element of the second frame section is configured to cooperate with the second fastening element of the first frame section. The identical first and second frame sections are configured to be fastened together to surround
(Continued)

the sign. The first recess of each of the first and second frame sections is configured to be positioned adjacent the post.

20 Claims, 12 Drawing Sheets

(52) U.S. Cl.
CPC .. *G09F 15/0037* (2013.01); *G09F 2007/1821* (2013.01); *G09F 2007/1826* (2013.01); *G09F 2007/1843* (2013.01); *G09F 2007/1878* (2013.01)

(58) Field of Classification Search
CPC ..... G09F 2007/1878; G09F 2007/1843; G09F 2007/1821; G09F 1/12; A47G 1/08; A47G 1/06
USPC ..... 40/780, 781, 612, 741, 586, 606.13, 40/606.14, 606.17
See application file for complete search history.

(56) References Cited

U.S. PATENT DOCUMENTS 2,110,555 A * 3/1938 Pfaff, Jr. ..... G09F 7/20 40/607.01
2,618,819 A 11/1952 Goodwillie
2,622,357 A 12/1952 Sprung
3,031,047 A * 4/1962 Williams ..... B01D 46/10 403/231
3,181,849 A 5/1965 Mitchell
3,782,724 A 1/1974 Rottman et al.
3,828,457 A * 8/1974 Willis ..... G09F 1/12 40/781
4,117,614 A * 10/1978 Bickford ..... A47G 1/08 40/741
4,582,739 A 4/1986 Givens
4,808,451 A 2/1989 McCue et al.
4,946,727 A 8/1990 Kessler
5,079,860 A * 1/1992 Nugent ..... A47G 1/10 40/780
5,283,096 A 2/1994 Greenberg et al.
5,343,642 A * 9/1994 Magnusson ..... A47G 1/06 40/762
5,440,464 A * 8/1995 Nowlin ..... G08B 5/006 340/321
5,675,923 A 10/1997 Sarkisian et al.
5,732,911 A 3/1998 Kulp et al.
5,890,603 A * 4/1999 Arguin ..... G09F 1/14 211/45
6,604,840 B2 8/2003 Watson
6,705,033 B1 3/2004 Greene et al.
6,962,017 B1 11/2005 Pounds
7,305,781 B1 * 12/2007 Mowry ..... G09F 3/12 40/124.5
7,386,928 B1 6/2008 Crorey
7,681,347 B1 3/2010 Welker et al.
7,770,861 B2 8/2010 Huxtable et al.
7,877,912 B1 2/2011 Ley-Owens
8,153,242 B2 4/2012 Wallace
8,337,971 B2 12/2012 Yaver
8,443,576 B2 5/2013 Petta
8,931,191 B2 1/2015 Masanek, Jr. et al.
8,939,419 B2 1/2015 Wallace et al.
9,135,836 B2 9/2015 Benumof et al.
9,159,252 B2 * 10/2015 Cai ..... E01F 9/615
9,752,291 B2 9/2017 Michael et al.
9,962,019 B1 * 5/2018 Padilla ..... G09F 1/12
2002/0046538 A1 4/2002 Bourbeau
2003/0110673 A1 * 6/2003 Tomboris ..... G09F 15/0037 40/612
2010/0162602 A1 7/2010 Da Ponte Moreira Rato et al.
2010/0176543 A1 7/2010 Burke et al.
2010/0307041 A1 12/2010 Tian et al.
2015/0167311 A1 6/2015 Mingyong et al.
2016/0055775 A1 2/2016 Landwehr

* cited by examiner

SIGN EDGE BUMPER ASSEMBLY

CROSS-REFERENCE TO RELATED APPLICATIONS

This Application is a Section 371 National Stage Application of International Application No. PCT/US2019/033673, filed 23 May 2019. International Application No. PCT/US2019/033673 claims the benefit of priority of U.S. Provisional Patent Application No. 62/680,060, filed Jun. 4, 2018. The contents of the priority applications are hereby incorporated by reference in their entirety.

BACKGROUND

A problem with common parking signs is that they are usually constructed with heavy gauge metal having sharp edges. They are posted at an optimal height for visibility; but in a society in which many people are distracted by looking down at their phones, such a height is also prime for unintentional run-ins with inattentive pedestrians in parking lots. This is particularly true for signs posted to mark handicapped parking spaces, which are near building entrances and walkways.

SUMMARY

In one aspect, an apparatus is configured to be used with a sign that is configured to be mounted on an elongated post having a longitudinal orientation. The apparatus includes identical first and second frame sections. Each of the first and second frame sections includes a first fastening element located at a first end thereof; a second fastening element located at a second end thereof; and a first recess between the first and second ends configured to accommodate the post. The first fastening element of the first frame section is configured to cooperate with the second fastening element of the second frame section. The first fastening element of the second frame section is configured to cooperate with the second fastening element of the first frame section. The identical first and second frame sections are configured to be fastened together to surround a perimeter edge of the sign. The first recess of each of the first and second frame sections is configured to be positioned adjacent the post.

This disclosure, in its various combinations, may also be characterized by the following listing of items:

1. An apparatus configured to be used with a sign that is configured to be mounted on an elongated post having a longitudinal orientation, the apparatus including identical first and second frame sections, each of the first and second frame sections including:
   - a first fastening element located at a first end thereof;
   - a second fastening element located at a second end thereof; and
   - a first recess between the first and second ends configured to accommodate the post;
   - wherein the first fastening element of the first frame section is configured to cooperate with the second fastening element of the second frame section; and
   - wherein the first fastening element of the second frame section is configured to cooperate with the second fastening element of the first frame section;
   - so that the identical first and second frame sections are configured to be fastened together to surround a perimeter edge of the sign; and
   - the first recess of each of the first and second frame sections is configured to be positioned adjacent the post.

2. The apparatus of item 1 wherein each of the first and second frame sections includes first and second substantially parallel legs joined by an intermediate leg.
3. The apparatus of item 2 wherein:
   - the first end is located on the first leg; and
   - the second end is located on the second leg.
4. The apparatus of either of items 2 or 3 wherein at least one of the first and second substantially parallel legs is configured to be oriented substantially parallel to the longitudinal orientation of the post.
5. The apparatus of either of items 2 or 3 wherein at least one of the first and second substantially parallel legs is configured to be oriented substantially perpendicular to the longitudinal orientation of the post.
6. The apparatus of any of items 1-5 wherein the first fastening element is a male connector and the second fastening element is a female connector.
7. The apparatus of item 6, wherein the female connector includes a bore and a channel in communication with the bore.
8. The apparatus of item 7, wherein the female connector includes a shoulder adjacent the channel.
9. The apparatus of item 8, wherein the male connector includes a protrusion configured to fit into the channel and engage the shoulder.
10. The apparatus of any of items 1-9 wherein the first fastening element and the second fastening element are configured to snap together.
11. The apparatus of any of items 1-10 further including a wrap element configured to surround the first and second frame sections.
12. The apparatus of item 11 wherein the wrap element is formed as a single unitary piece.
13. The apparatus of any of items 11-12 wherein the wrap element includes a resilient, compressible material.
14. The apparatus of any of items 11-13 wherein the wrap element includes a second recess configured to be positioned adjacent the post.
15. The apparatus of any of items 11-14 wherein the wrap element includes an interior channel configured to engage with perimeter surfaces of both of the first and second frame sections.
16. The apparatus of item 15 wherein the perimeter surfaces of both of the first and second frame sections include a ridge.
17. The apparatus of item 16 wherein the interior channel includes a groove having a contour that complements and engages the ridge.
18. The apparatus of any of items 11-17 wherein the wrap element includes an exterior channel.
19. The apparatus of item 18 wherein the exterior channel is located on a perimeter surface of the wrap element.
20. The apparatus of item 18 wherein the exterior channel is located on a front or back surface of the wrap element.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

While the above-identified Figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The Figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION

The current concept describes a system or assembly including a frame configured for use with an optional cushioned (e.g., foam) wrap for encircling the edge of a sign. Options can include reflectors or illumination on the edge bumper. In an exemplary embodiment, a sign frame is attachable around the sharp edges of the sign to blunt the edges of the sign perimeter. The frame is formed of relatively hard plastic as a two-piece snap-together frame. The two pieces are identical to each other, with one flipped relative to the other to surround the sign. A recess is provided on each piece to provide clearance for the sign post. Detents on the snap finger of one frame piece cooperate with a cavity in the other frame piece. A tool can be used to disassemble the frame pieces from each other.

In an exemplary embodiment, as an upgrade, a cushioned wrap can be stretched around and attached to the hard plastic frame. In cases in which the frame will be used with the cushioned wrap, the frame need not have a blunt edge; rather, the frame can have a barbed or other cross-sectional configuration to more securely mate with the cushioned wrap.

In an exemplary embodiment, as yet another upgrade option, another element such as a light-emitting diode (LED) conduit or reflective strips can be inserted into channels provided on the outside of the cushioned wrap.

In yet another exemplary embodiment, the cushioned wrap is over-molded around the perimeter of a sign. The metal parking sign is drilled or otherwise provided with holes about its perimeter. A soft, thermoplastic material is over-molded over the sign edge so that the material flows through the holes. After the material cures, the cushion is firmly mechanically interlocked with the sign. In still another embodiment, the cushioned wrap is over-molded around outer edges of each of the pieces forming the frame.

Figure 1:
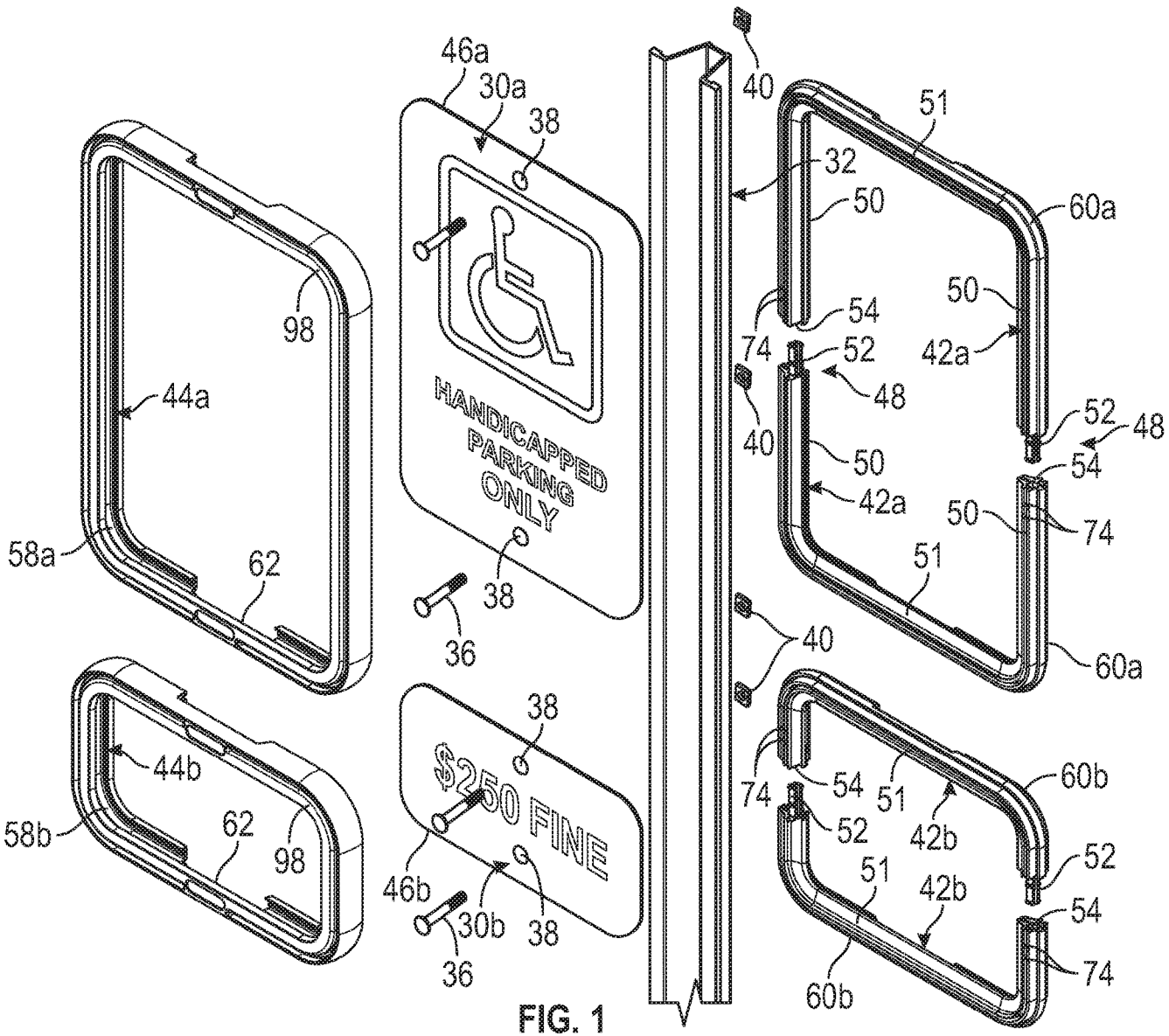
FIG. 1 is an exploded perspective view of components of an exemplary sign edge bumper assembly to be used with signs configured for mounting on a post.
Figure 3:
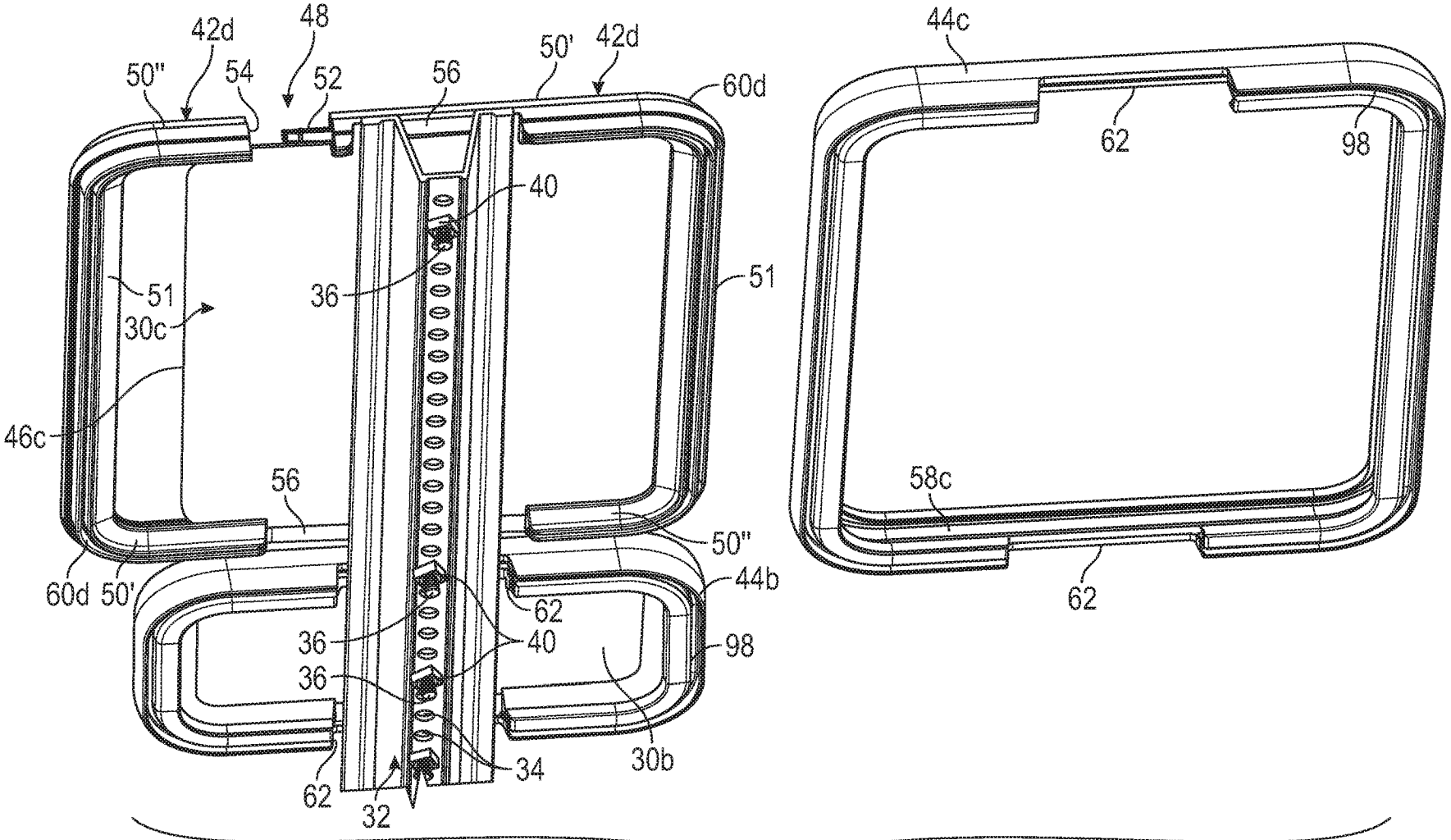
FIG. 3 is a rear view of a partially assembled sign edge bumper assembly in a third embodiment.

FIG. 1 is an exploded view of components of a first exemplary embodiment of a sign edge bumper assembly, configured for use with a sign that is designed to be mounted on a post. As shown in FIG. 1, signs 30*a* and 30*b* are positioned for mounting on a sign post 32. As shown in FIG. 3, post 32 includes a plurality of apertures 34 configured for acceptance of fasteners 36, such as bolts, which also pass through apertures 38 of signs 30.

In this description, analogous structures will be referred to with like reference numerals. However, where specific embodiments of those structures are described, the numeral may be modified by a lowercase letter, apostrophe, or double apostrophe. In cases where the description pertains to multiple embodiments of the structure, the reference numeral may be used without the letter or apostrophe designations.

In a known method for mounting sign 30 on post 32, fasteners 36 may pass through apertures 38 of sign 30 and apertures 34 of post 32 and be secured thereon by fasteners 40, such as nuts. Components of a sign edge bumper assembly include frame sections 42 and optionally cushioned wrap 44. In an exemplary embodiment, two identical frame sections 42 snap together to surround the perimeter edge 46 of a sign 30. After two frame sections 42 are assembled around the perimeter edge 46 of a sign 30, cushioned wrap 44 may be stretched around the assembled frame sections 42 for attachment onto the frame sections 42.

In FIG. 1, sign 30*a* is relatively large, and frame sections 42*a* are configured to fit around perimeter 46*a* when connected to each other in a manner that will be more fully described below. Sign 30*b* is relatively small, and frame sections 42*b* are configured to fit around perimeter 46*b* when connected to each other in a manner that will be more fully described below. In FIG. 1, cushioned wrap 44*a* is sized to fit (with stretching, if necessary) around connected frame sections 42*a*, and cushioned wrap 44*b* is sized to fit (with stretching, if necessary) around connected frame sections 42*b*. Channel 58*a* of cushioned wrap 44*a* is configured to fit around and mate with perimeter surface 60*a* of connected frame sections 42*a*. Similarly, channel 58*b* of cushioned wrap 44*b* is configured to fit around and mate with perimeter surface 60*b* of connected frame sections 42*b*.

Figure 2:
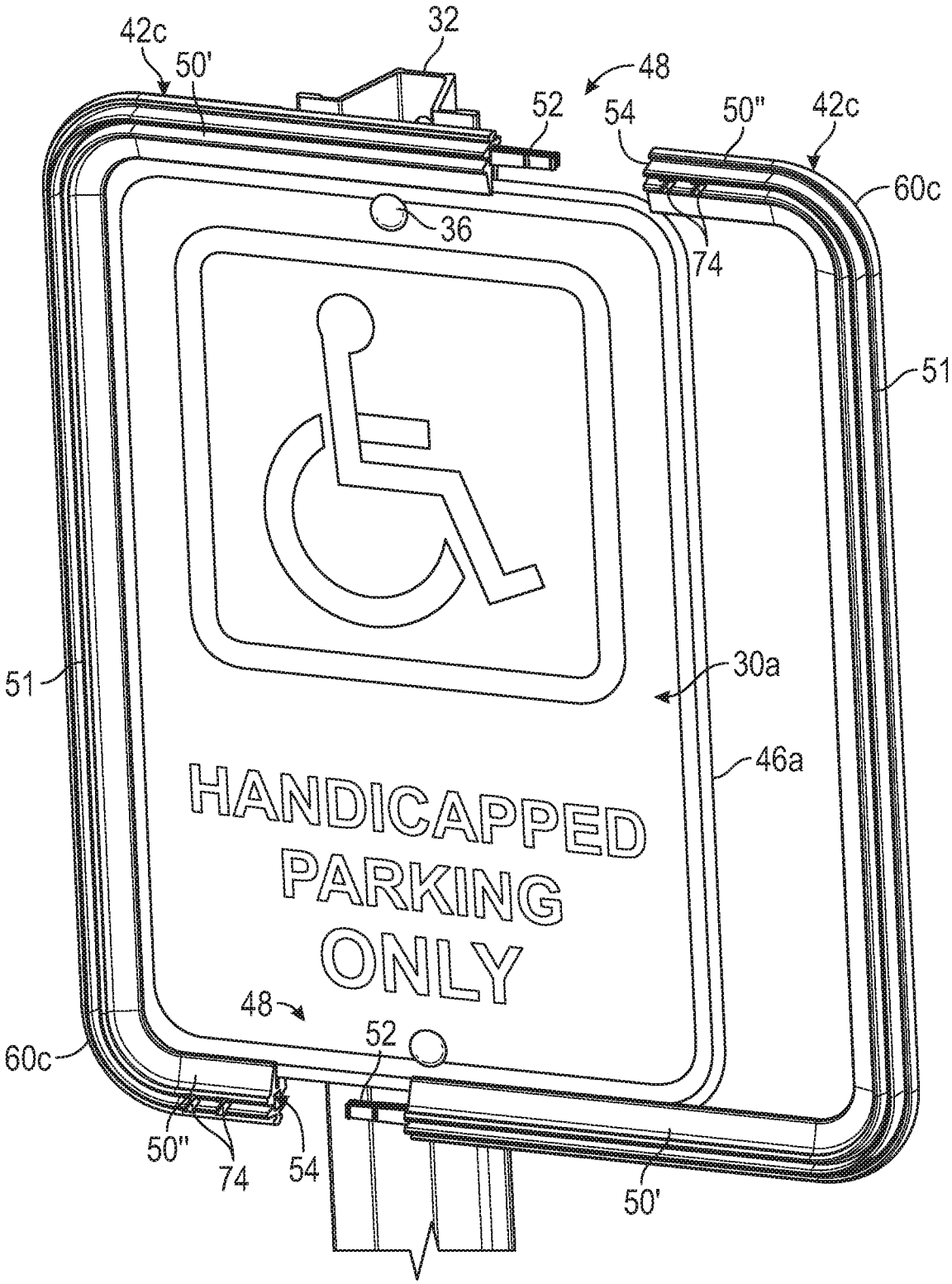
FIG. 2 is a perspective view of a partially assembled second embodiment of a sign edge frame.

FIG. 2 shows a second exemplary embodiment of frame sections 42*c*. Frame sections 42*c* are configured to fit around perimeter 46*a* when connected to each other in a manner that will be more fully described below. Cushioned wrap 44*a* is sized to fit (with stretching, if necessary) around connected frame sections 42*c*. Channel 58*a* of cushioned wrap 44*a* is configured to fit around perimeter surface 60*c* of connected frame sections 42*c*.

Frame sections 42*c* differ from frame sections 42*a* in the placement of joints 48. As shown in FIGS. 1 and 2, sign 30*a* is rectangular, with a greater height dimension than width dimension. With frame sections 42*a* of FIG. 1, joints 48 are positioned along a side of frame section 42 that is configured for orientation substantially parallel to a longitudinal dimension of post 32. In contrast, as shown in FIG. 2, joints 48 of frame sections 42*c* are positioned on a side of frame section 42*c* configured to be oriented substantially perpendicular to a longitudinal orientation of post 32. Moreover, as shown in FIG. 1, joints 48 of frame sections 42*a* are positioned so that parallel legs 50 have approximately a common length. In contrast, as shown in FIG. 2, in frame section 42*c*, leg 50' is longer than leg 50".

FIG. 3 shows an embodiment in which a sign edge bumper assembly is configured for use with a rectangular sign that is wider than it is tall. Frame sections 42*d* are configured to fit around perimeter 46*c* of sign 30*c* when connected to each other in a manner that will be more fully described below. Cushioned wrap 44*c* is sized to fit (with stretching, if necessary) around connected frame sections 42*d*. Channel 58*c* of cushioned wrap 44*c* is configured to fit around perimeter surface 60*d* of connected frame sections 42*d*. In another embodiment, joints 48 may be positioned on the vertically oriented legs of frame 42, as in FIG. 1.

While all of the illustrated signs are shown as being rectangular, it is contemplated that the descriptions of the disclosed sign edge bumper assembly can also be modified to accommodate signs with other perimeter shapes including square, circular, octagonal, diamond, kite and other symmetrical shapes. Moreover, it is contemplated that joints 48 between identical frame sections 42 can be positioned at many locations along leg 50 of a frame section 42. Descriptions of joint 48 and its components apply to such joints located at any position along frame sections 42.

As shown in the illustrated embodiments, and exemplary embodiments, a complete frame about a perimeter edge 46 of a sign 30 is provided by the mutual attachment of two identical frame sections 42 to each other. However, it is contemplated that with some sign shapes, it may be suitable to use more than two frame sections to fully surround the sign. In all cases, it is preferable that the frame sections for a particular sign are identical to each other. This feature simplifies manufacturing, packaging, inventory, assembly and use, especially for signs of standardized shapes and sizes.

In exemplary embodiments, each frame section 42 includes a first attachment feature 52 at an end of a leg 50, which is configured for cooperating engagement with a second attachment feature 54 at an end of an opposite leg 50. In exemplary embodiments, the cooperating frame sections 42 for a particular sign 30 are identical to each other, but are flipped in orientation so that a first attachment feature 52 of a first one of the frame sections 42 cooperates with the second attachment feature 54 of the second frame section 42. As shown in FIG. 3, in an exemplary embodiment, each frame section 42 includes a recess 56 that is spaced from joint 48 and configured to accommodate post 32. While not shown explicitly in the front views of FIGS. 1 and 2, it is to be understood that frame sections 42*a*, 42*b* and 42*c* also include recess 56 on a rear surface to surround post 32. In an exemplary embodiment, recess 56 is long enough to accommodate a width of post 32 of about 4 inches. While joint 48 could be positioned at recess 56, placing recess 56 on an area of frame section 42 spaced from joint 48 allows for more material to be used at the joint 48 for forming the first and second attachment features 52, 54.

To attach frame sections 42 to each other to cover perimeter edge 46 of sign 30, first attachment feature 52 and second attachment feature 54 are mutually connected at each joint 48. Thus, the mutually attached frame sections 42 fully surround perimeter edge 46 of sign 30 to thereby blunt the edge, as well as offer an aesthetically pleasing frame design element. In exemplary embodiments, an additional cushioned wrap 44 may be assembled onto the connected frame sections 42 to provide cushioning properties about a perimeter 46 of sign 30. In exemplary embodiments, cushioned wrap 44 includes an interior channel 58 configured to fit over a perimeter 60 of frame sections 42. Cushioned wrap 44 also includes a recess 62 to accommodate sign post 32.

Figure 4:
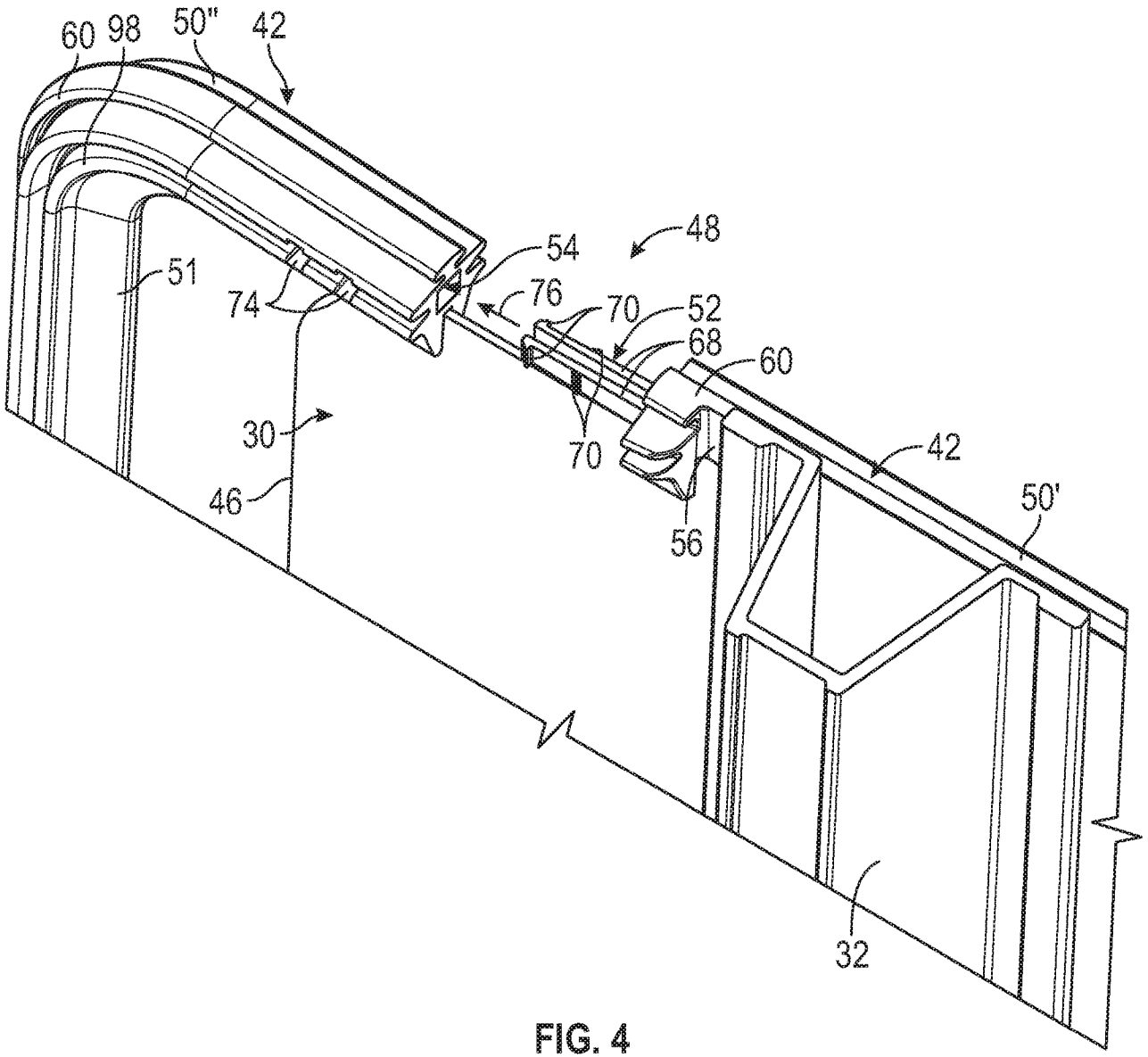
FIG. 4 is an enlarged perspective view of a portion of the embodiment of FIG. 3, shown from a slightly different angle.

FIG. 4 is an enlarged partial perspective view of an upper joint 48, as shown in FIGS. 2 and 3. In an exemplary embodiment, first attachment feature 52 is a male connector, and second attachment feature 54 is a female recess configured for reception of and mutual engagement with first attachment feature 52. In an exemplary embodiment, first attachment feature 52 includes spaced-apart elongated tongues 68, each having attachment barbs 70 thereon.

Figure 5:
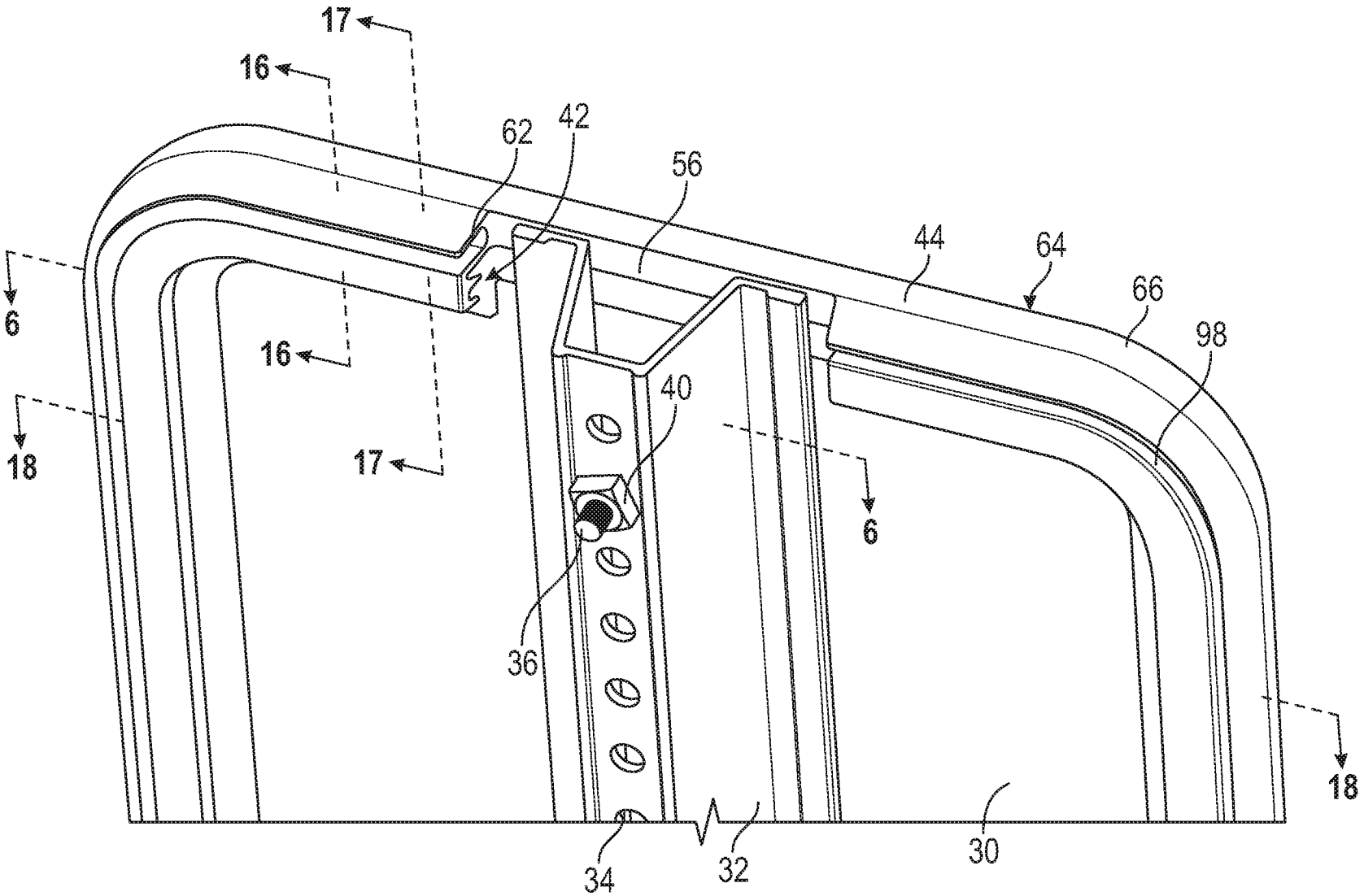
FIG. 5 is a partial rear perspective view of an exemplary embodiment of a sign edge bumper assembly attached to a post-mounted sign.

FIG. 5 shows a partial perspective view of a sign 30 with an assembly 64 thereon of assembled frame sections 42 and cushioned wrap 44. In exemplary embodiments, cushioned wrap 44 is a single unitary piece with no joints or seams. Thus, a continuous perimeter 66 of cushioned wrap 44 is presented to a viewer, with no visible joints therein.

Figure 6:
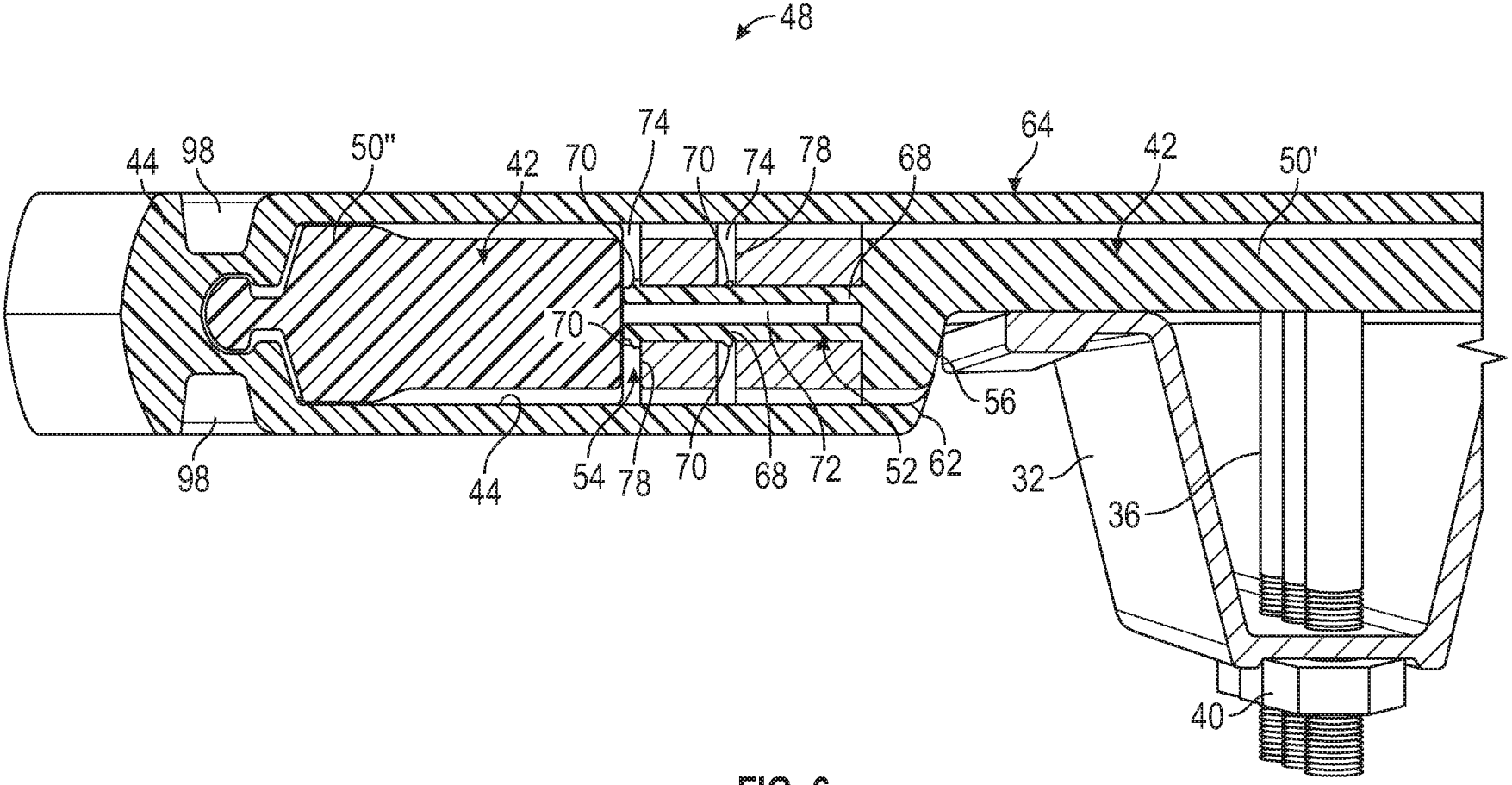
FIG. 6 is a cross-sectional view of a post-mounted sign provided with a frame and cushioned wrap, taken at the position of line 6-6 shown in FIG. 5.
Figure 7:
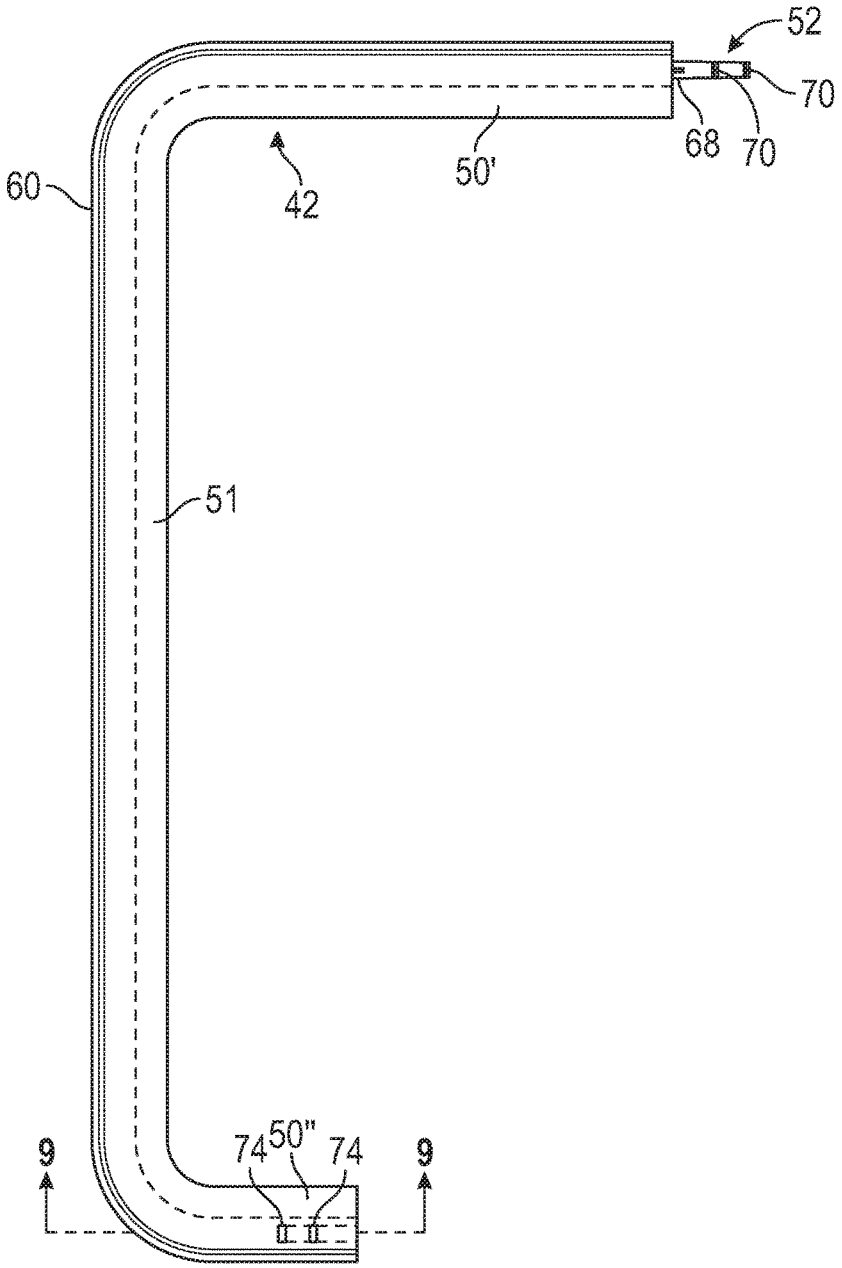
FIG. 7 is a plan view of an exemplary frame section.

FIG. 6 is a partial cross-sectional view taken along line 6-6 of FIG. 5. As shown in FIG. 6, in an exemplary embodiment, second attachment feature 54 is configured as a cavity having a central bore 72 with channels 74. In an exemplary embodiment, first attachment feature 52 is made from a resilient material that allows tongues 68 to flex toward each other for advancement of first attachment feature 52 in insertion direction 76 (labeled in FIG. 4) into second attachment feature 54. Once barbs 70 pass shoulders 78 of second attachment feature 52, barbs 70 snap into place in channels 74 of second attachment feature 54 due to the resilient nature of the material used to form frame sections 42. Thus, joint 48 is securely maintained by the cooperating attachment features 52, 54 of the mutually engaged frame sections 42. In exemplary embodiments, channels 74 are accessible from an outside of frame section 42, so that a removal tool can be inserted therein to compress barbs 70 into bore 72, thereby allowing the mutual detachment of first attachment feature 52 and second attachment feature 54 in a direction opposite of the insertion direction 76.

While a particular snap-fit joint 48 is illustrated and described, it is contemplated that other joint structures can be used, including those employing different detent mechanisms or cooperating attachment structures. In an exemplary embodiment, cooperating frame sections 42 are formed of a relatively rigid yet resilient material. While metals can be used, it is contemplated that polymer and plastic materials are especially suitable because of the ease with which they can be formed into desired configurations, economy, lightless in weight and durability.

In an exemplary embodiment, cushioned wrap 44 is formed of a relatively soft, compressible, impact-absorptive, resilient material such as a thermoplastic elastomer (TPE), thermoplastic urethane (TPU), liquid silicone rubber (LSR), thermoplastic vinyl (TPV) or other foam material. In some embodiments, the material of cushioned wrap 44 has a hardness of 30 to 40 Shore A. In an exemplary embodiment, cushioned wrap 44 is a single seamless structure that is stretched to fit over the connected frame sections 42.

Especially suitable materials for the components 42, 44, 104 of assemblies 64, 102 are durable in view of fluctuating temperatures and exposure to climate elements such as precipitation and ultraviolet light. Assembly 64 of frame sections 42 and cushioned wrap 44 can be connected to any existing sign 30 for which the components 42, 44 are sized. In many cases, the sign 30 need not be removed from post 32 for the attachment of sign edge bumper assembly 64.

Figure 10:
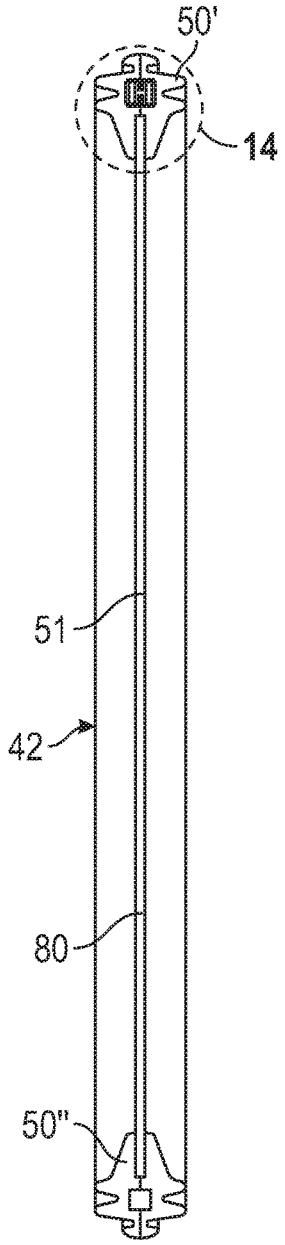
FIG. 10 is an end view of the exemplary frame section, as viewed from a right side of FIG. 7.
Figure 8:
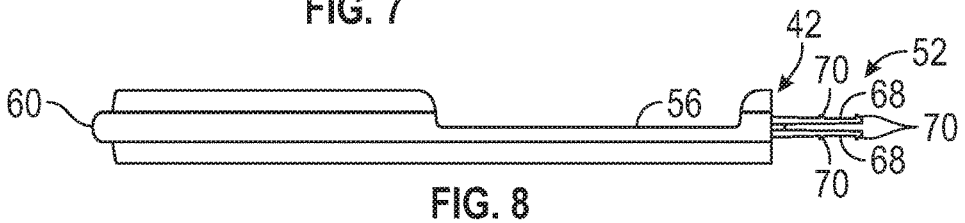
FIG. 8 is a top view of the frame section of FIG. 7.
Figure 9:
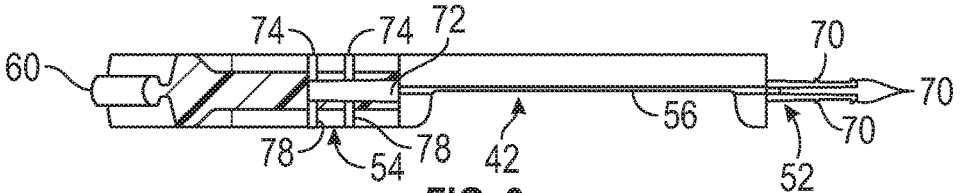
FIG. 9 is a cross-sectional view, taken along line 9-9 of FIG. 7.
Figure 11:
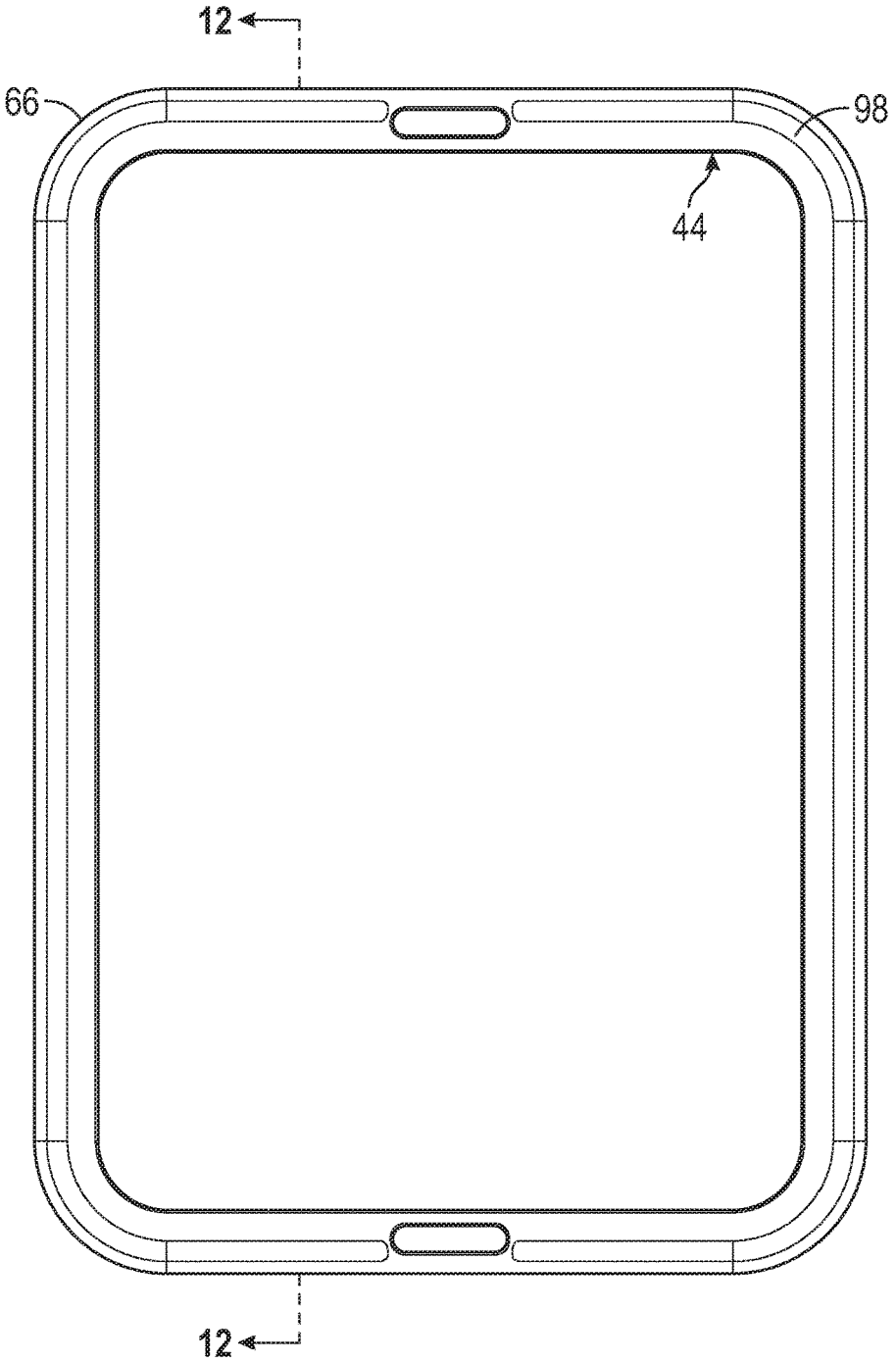
FIG. 11 is a plan view of an exemplary cushioned wrap of the present disclosure.
Figure 12:
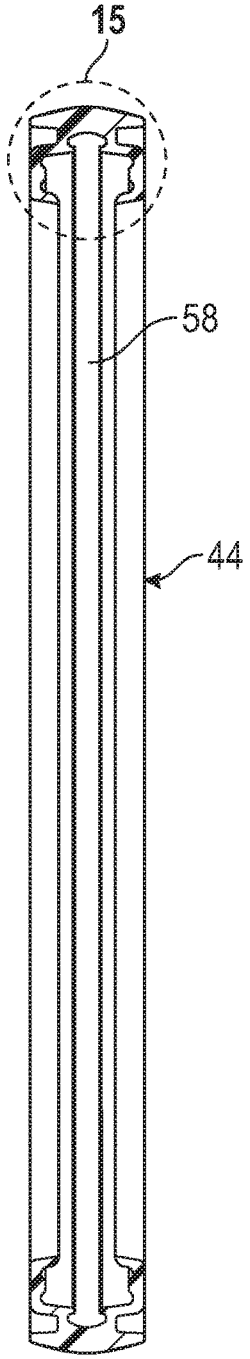
FIG. 12 is a cross-sectional view, taken along line 12-12 of FIG. 11.
Figure 13:
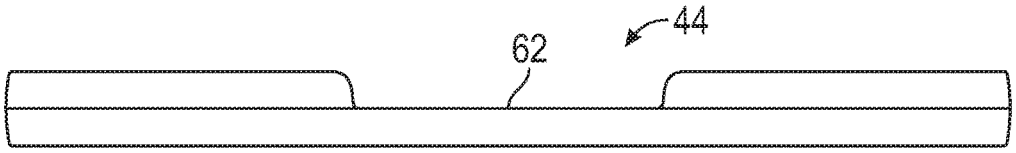
FIG. 13 is a top view of the cushioned wrap of FIG. 11.

FIGS. 7 through 10 and 14 show an exemplary embodiment of a frame section 42. FIGS. 11 through 13 and 15 show an exemplary embodiment of a cushioned wrap 44. While exemplary configurations are shown in the illustrations, it is to be understood that other sizes and shapes can also be deployed for a frame section 42 and cushioned wrap 44 of the described assembly 64. As shown in FIG. 10, frame section 42 includes an interior channel 80 to accept perimeter edge 46 of planar sign 30.

Figure 14:
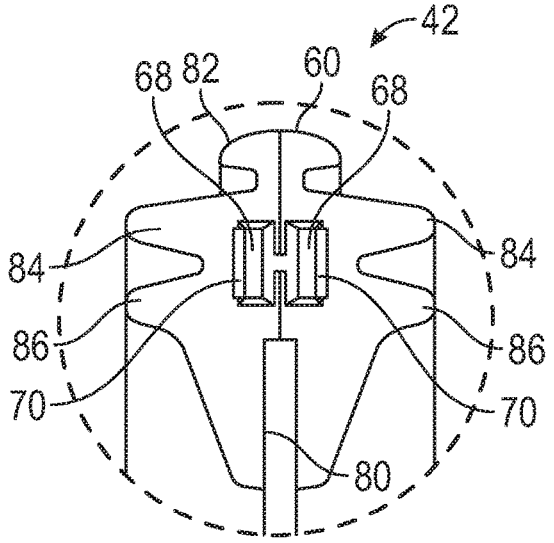
FIG. 14 is an enlarged view of the encircled area labeled "14" on FIG. 10.
Figure 15:
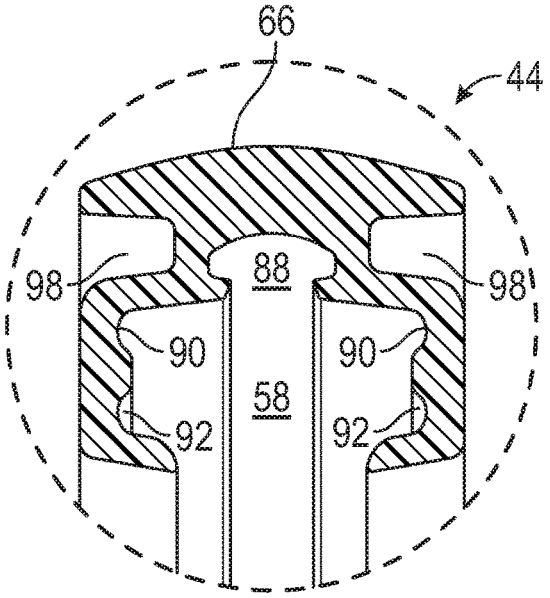
FIG. 15 is an enlarged view of the encircled area labeled "15" on FIG. 12.

FIG. 14 is an enlarged view of the encircled area labeled "14" on FIG. 10. In an exemplary embodiment, frame section 42 has a cross-sectional shape including a plurality of ridges 82, 84, 86 for mating attachment with complementary recesses in interior channel 58 of cushioned wrap 44. FIG. 15 is an enlarged view of the encircled portion labeled "15" in FIG. 12. In an exemplary embodiment, interior channel 58 of cushioned wrap 44 includes grooves 88, 90, 92 that are contoured to engage with ridges 82, 84, 86 of frame section 42, respectively.

Figure 16:
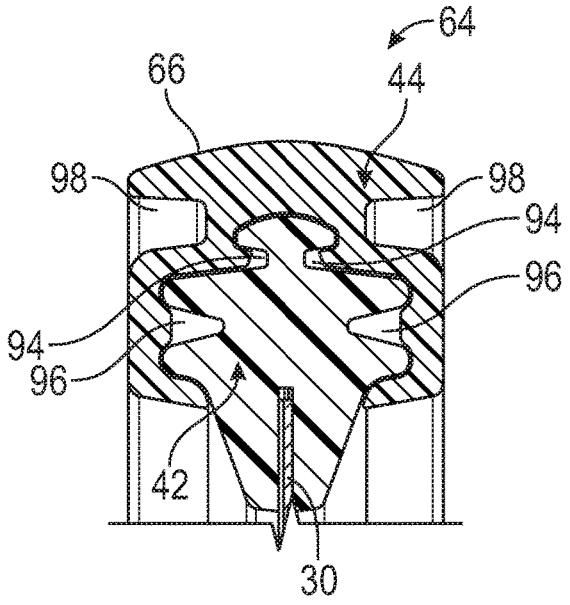
FIG. 16 is a partial cross-sectional view of an assembly of a sign, frame and cushioned wrap, such as taken at line 16-16 of FIG. 5.
Figure 17:
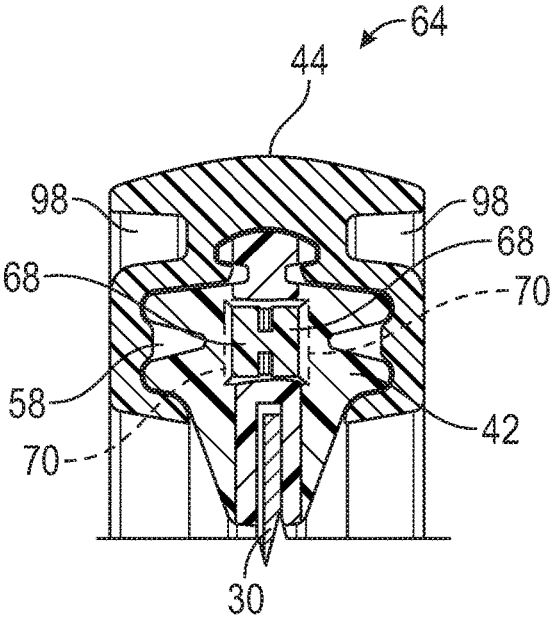
FIG. 17 is a partial cross-sectional view of an assembly of a sign, frame and cushioned wrap, such as taken at line 17-17 of FIG. 5.

As shown in FIG. 16, when cushioned wrap 44 is attached to frame section 42 to form assembly 64, spaces 94 and 96 remain between frame section 42 and cushioned wrap 44. These void volume spaces allow for more freedom of motion of cushioned wrap 44 as it is stretched and flexed into place around frame section 42. However, because of the mating contours of ridges 82, 84, 86 and the grooves 88, 90, 92, a secure fit of cushioned wrap 44 over frame section 42 is obtained. In an exemplary embodiment, perimeter surface 66 of cushioned wrap 64 extends an entire width of the cushioned wrap 44 (shown as a horizontal dimension in FIGS. 15 through 17). In an exemplary embodiment, channels 98 are provided on front and back surfaces of cushioned wrap 44. The absence of material in channels 98 allows for more flexibility in cushioned wrap 44 as it is maneuvered into place over frame section 42 and enhances the flexibility and cushioning effect provided by the perimeter surface 66 of the cushioned wrap 44. Moreover, in some embodiments, other features can be provided as insertions into channels 98. Suitable structures for insertion into channels 98 include strips of LED lighting conduit or reflective material, for example.

Figure 18:
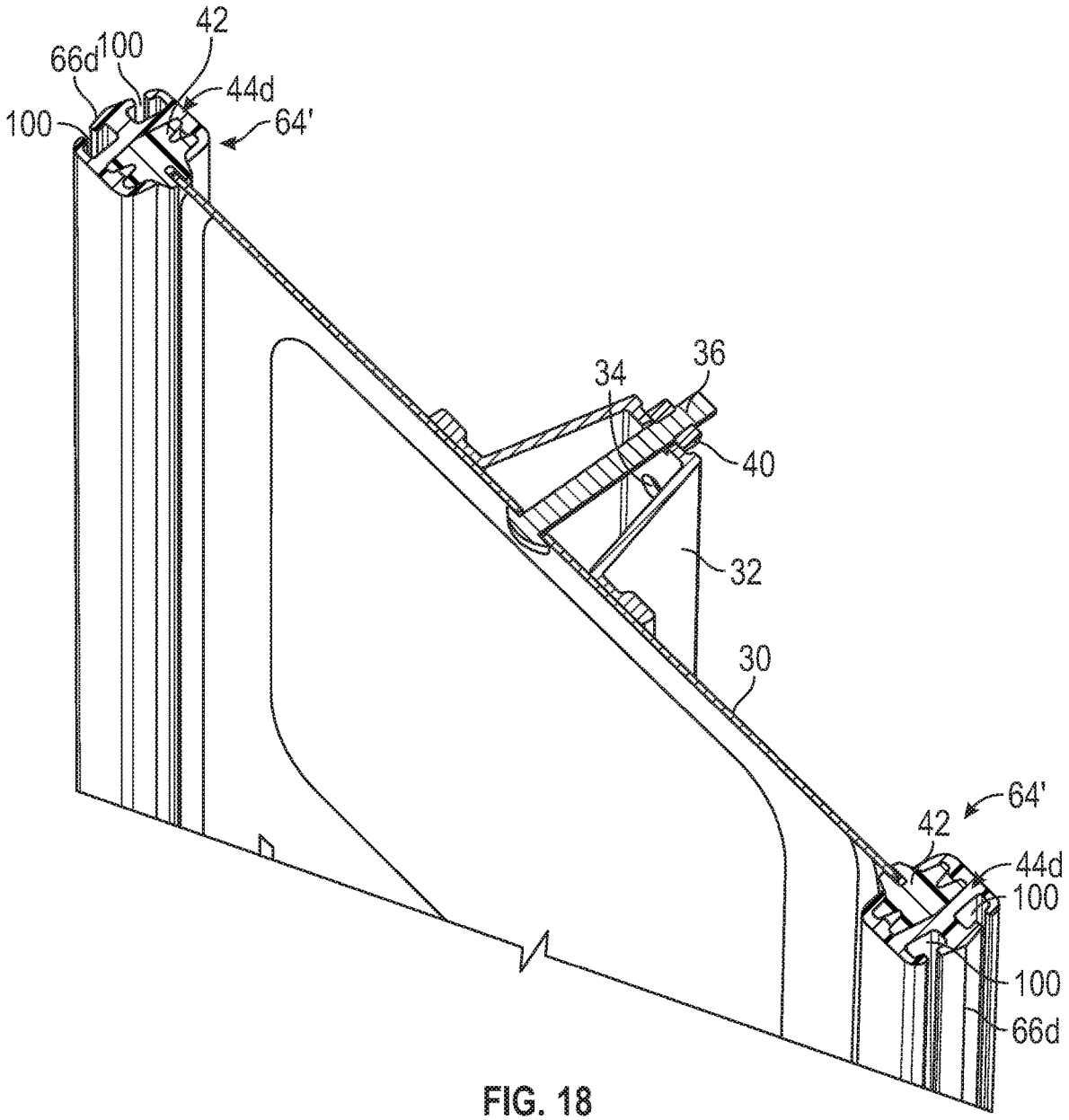
FIG. 18 is a cross-sectional view, positioned as shown by line 18-18 of FIG. 5, of a fourth exemplary embodiment of an assembly of a sign, frame and cushioned wrap.
Figure 19:
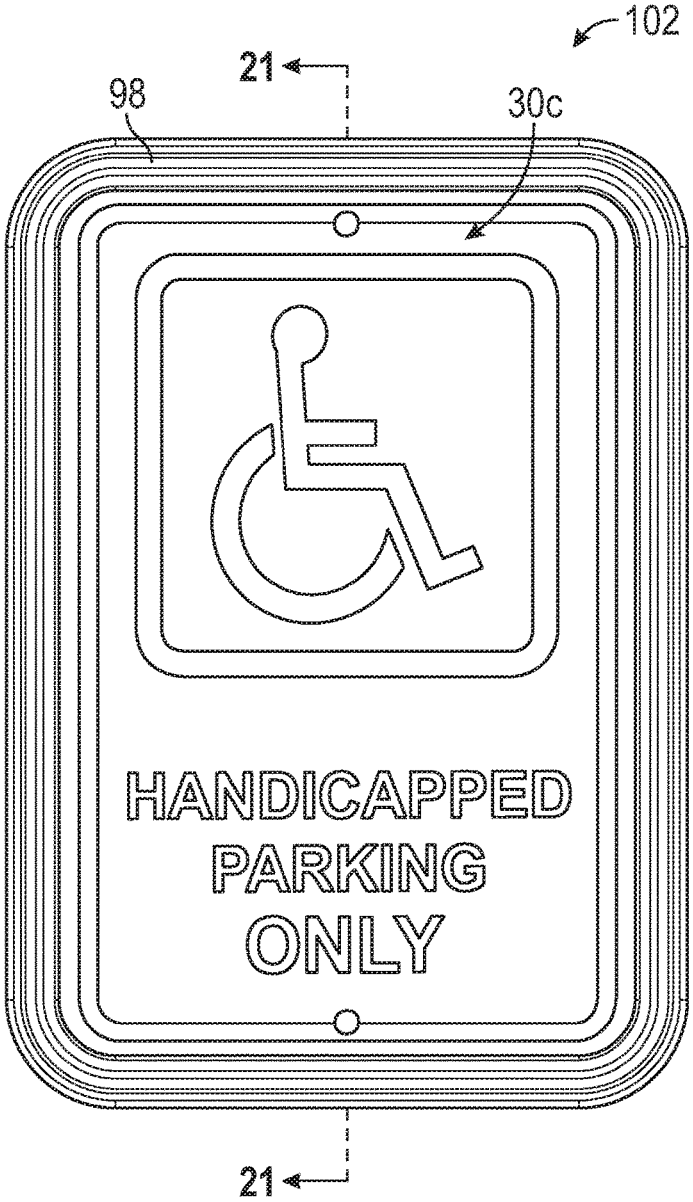
FIG. 19 is a plan view of an exemplary assembly of a sign and cushioned wrap in a fifth exemplary embodiment.
Figure 21:
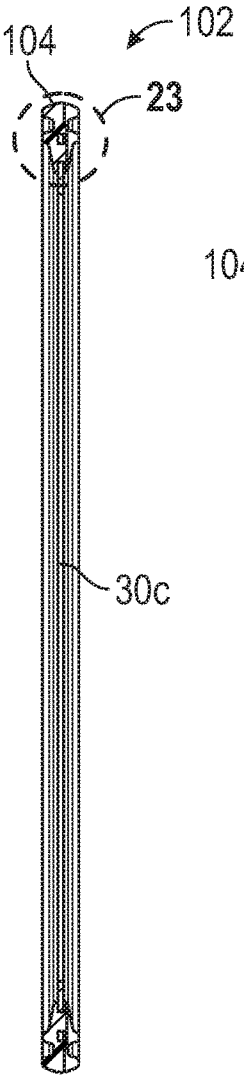
FIG. 21 is a cross-sectional view taken along line 21-21 of FIG. 19.
Figure 22:
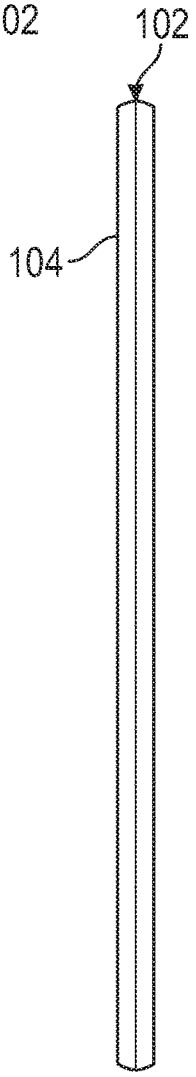
FIG. 22 is a right side view of the assembly of FIG. 19.

FIG. 18 is a cross-sectional view of a sign 30 used with sign edge bumper assembly 64' composed of frame section 42 and cushioned wrap 44*d*. In the illustrated embodiment, perimeter surface 66*d* includes channels 100 thereon. Channels 100 are similar in function and effect to channels 98 described with reference to other embodiments of cushioned wrap 44. However, channels 100 are positioned on a perimeter surface of wrap 44*d*, while channels 98 are located on front or back side surfaces of wrap 44*a*, 44*b*, 44*c*. It is contemplated that cushioned wrap 44 may include any number of channels or other surface discontinuations, placed in locations desired by a user to achieve any particular visual effect or cushioning effect.

Figure 20:
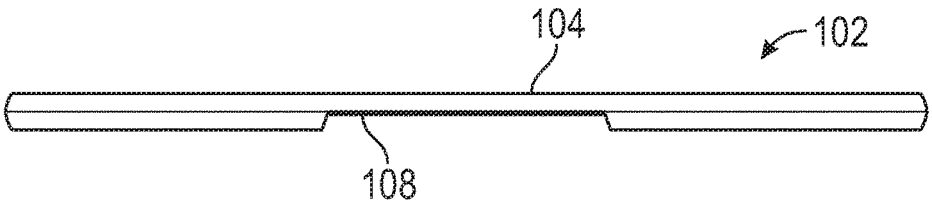
FIG. 20 is a bottom view of the assembly of FIG. 19.
Figure 23:
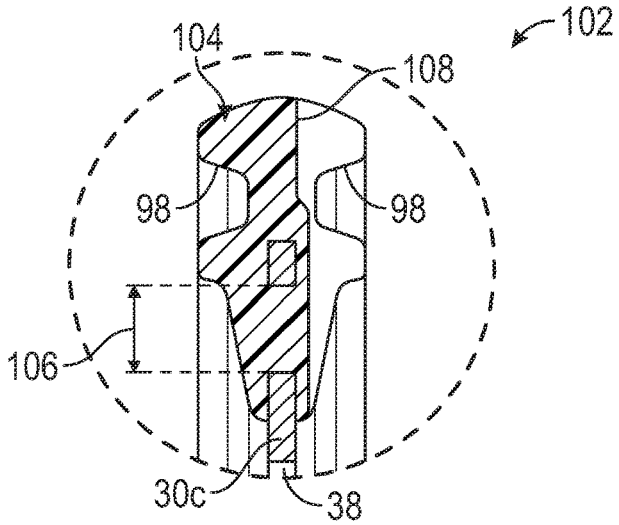
FIG. 23 is an enlarged view of the encircled portion of FIG. 21 labeled "23."
Figure 24:
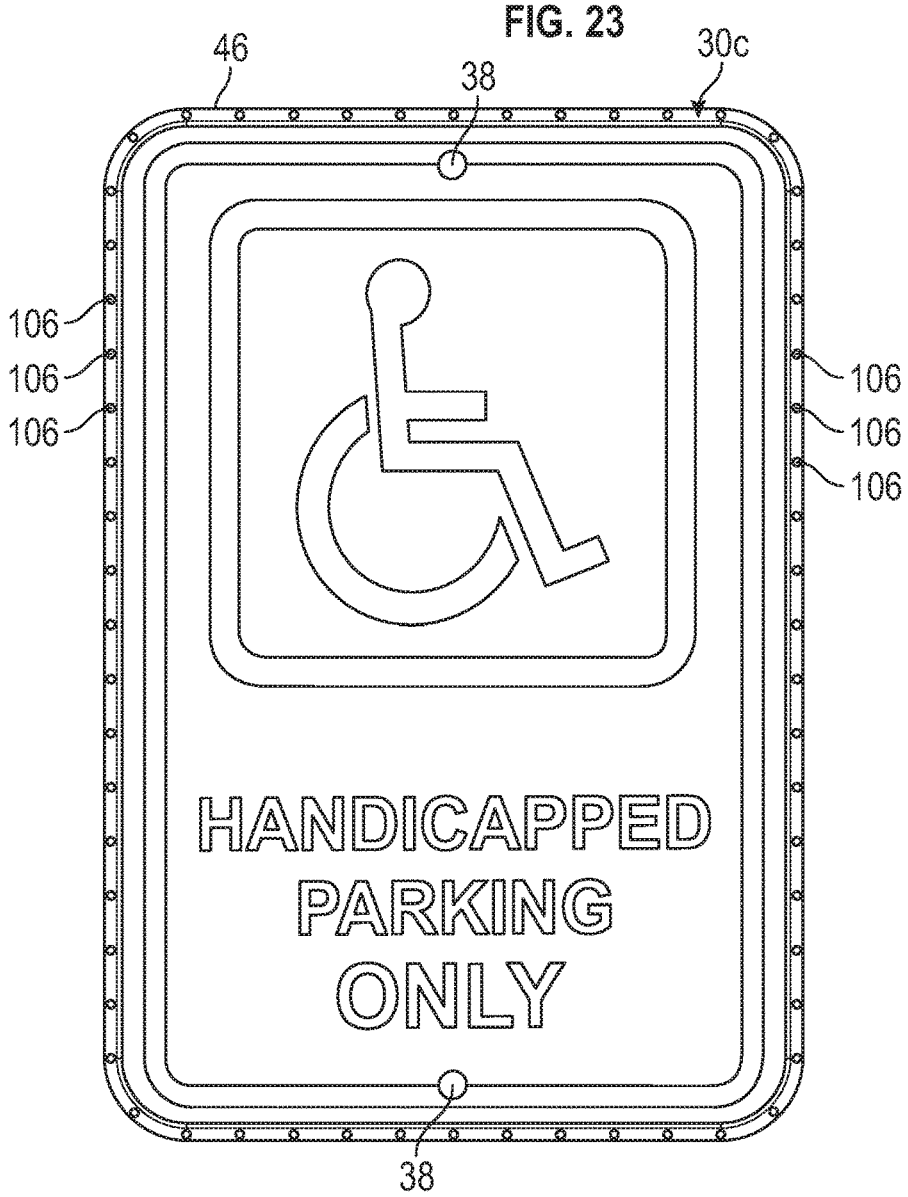
FIG. 24 is a plan view of a sign used in the assembly of FIG. 19.
Figure 25:
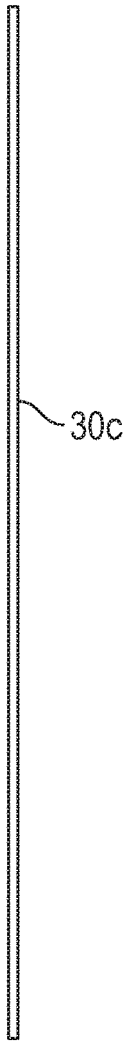
FIG. 25 is a side view of the sign of FIG. 24.

FIGS. 19 through 23 show another exemplary embodiment of an assembly 102 of a sign 30*c* and an edge bumper 104. As shown in FIG. 24, sign 30*c* is provided with a plurality of holes 106 near perimeter 46. Edge bumper 104 is formed onto sign 30*c* by over molding a cushion material around the perimeter edge 46 so that some of the material flows through holes 106. Once the material cures, edge bumper 104 is firmly mechanically interlocked with sign 30*c*. As shown in FIGS. 20 and 23, recess 108 is provided in edge bumper 104 to accommodate a sign post 32 on which assembly 102 is to be mounted.

Several methods can be used for using assembly 64 with a sign 30 configured to be mounted on post 32. As shown in FIG. 1, for example, fasteners 36, 40 are provided for mounting signs 30*a*, 30*b* on post 32. Components of assemblies 64 include two identical frame sections 42*a* configured for the size of sign 30*a*, a cushioned bumper 44*a* configured to fit around a frame formed by the frame sections 42*a*, two identical frame sections 42*b* configured for the size of sign 30*b*, and a cushioned bumper 44*b* configured to fit around a frame formed by the frame sections 42*b*. While methods for installing assembly 64 on sign 30*a* are specifically described, it is to be understood that these methods apply to all analogous structures for signs of different shapes and sizes. Components of assembly 64 can be installed on sign 30 while sign 30 is mounted to post 32; alternatively, components of assembly 64 can be installed on sign 30 while sign 30 is not mounted to post 32. Either before or after assembly of frame sections 42 and/or cushioned wrap 44 on sign 30, sign 30 can be mounted on post 32 via fasteners 36 passed through aligned apertures 38, 34 and secured by fasteners 40.

The two frame sections 42 are oriented with respect to each other to surround perimeter edge 46 of sign 30, so that first attachment feature 52 of one of the frame sections 42 is aligned for insertion into second attachment feature 54 of the other of the frame sections 42. The first and second attachment features 52, 54 are mutually connected, with perimeter 46 of sign 30 held in groove 80 of frame sections 42, to form a complete frame that surrounds sign 30. Cushioned wrap 44 is placed and stretched about the connected frame sections 42 so that perimeter surface 60 of frame sections 42 is received in and engagingly mates with groove 58 of cushioned wrap 44. In this method, care is taken to orient the frame sections 42 and cushioned wrap 44 so that their respective recesses 56, 62 are aligned to surround post 32.

Thus, assembly 64 of frame sections 42 and cushioned wrap 44 can be pre-installed on sign 30 before mounting sign 30 on post 32. In another case, where sign 30 is already mounted to post 32, assembly 64 of frame sections 42 and cushioned wrap 44 can be installed on sign 30 without removal of sign 30 from post 32. In yet another case, where sign 30 is mounted to post 32, sign 30 can be removed from post 32 before installation of assembly 64 of frame sections 42 and cushioned wrap 44 thereon. In yet another case, where assembly 102 (shown in FIGS. 19-23) is to be used, edge bumper 104 is usually provided on sign 30*c* when the sign 30*c* is not mounted on a post 32.

Non-limiting examples of sign edge bumper assemblies follow. As shown in FIGS. 1-18, an apparatus is configured to be used with a sign 30 that is configured to be mounted on an elongated post 32 having a longitudinal orientation. The apparatus includes identical first and second frame sections 42. Each of the first and second frame sections includes a first fastening element 52 located at a first end thereof; a second fastening element 54 located at a second end thereof; and a first recess 56 between the first and second ends configured to accommodate the post 32. The first fastening element 52 of the first frame section 42 is configured to cooperate with the second fastening element 54 of the second frame section 42; moreover, the first fastening element 52 of the second frame section 42 is configured to cooperate with the second fastening element 54 of the first frame section 42 so that the identical first and second frame sections 42 are configured to be fastened together to surround a perimeter edge 46 of the sign 30. The first recess 56 of each of the first and second frame sections 42 is configured to be positioned adjacent the post 32.

In an exemplary embodiment, each of the first and second frame sections 42 includes first and second substantially parallel legs 50 joined by an intermediate leg 51. In an exemplary embodiment, the first end is located on the first leg 50 and the second end is located on the second leg 50. In an exemplary embodiment as shown in FIG. 1, at least one of the first and second substantially parallel legs 50 is configured to be oriented substantially parallel to the longitudinal orientation of the post 32. In an exemplary embodiment as shown in FIG. 2, at least one of the first and second substantially parallel legs 50', 50" is configured to be oriented substantially perpendicular to the longitudinal orientation of the post 32.

In an exemplary embodiment, the first fastening element 52 is a male connector and the second fastening element 54 is a female connector. In an exemplary embodiment as shown in FIG. 6, the female connector 54 includes a bore 72 and a channel 74 in communication with the bore 72. In an exemplary embodiment, the female connector 54 includes a shoulder 78 adjacent the channel 74. In an exemplary embodiment, the male connector 52 includes a protrusion 70 configured to fit into the channel 74 and engage the shoulder 78. In an exemplary embodiment, the first fastening element 52 and the second fastening element 54 are configured to snap together.

In an exemplary embodiment, an apparatus further includes a wrap element 44 configured to surround the first and second frame sections 42. In an exemplary embodiment, the wrap element 44 is formed as a single unitary piece. In an exemplary embodiment, the wrap element 44 includes a resilient, compressible material. In an exemplary embodiment, the wrap element 44 includes a second recess 62 configured to be positioned adjacent the post 32. In an exemplary embodiment, the wrap element 44 includes an interior channel 58 configured to engage with perimeter surfaces 60 of both of the first and second frame sections 42.

In an exemplary embodiment as shown in FIGS. 14 and 16, the perimeter surfaces 60 of both of the first and second frame sections 42 include a ridge 82, 84, 86. In an exemplary embodiment as shown in FIGS. 15 and 16, the interior channel 58 includes a groove 88, 90, 92 having a contour that complements and engages the ridge 82, 84, 86.

In an exemplary embodiment, the wrap element includes one or more exterior channels 98, 100. In an exemplary embodiment as shown in FIG. 18, the exterior channel 100 is located on a perimeter surface 66*d* of the wrap element 44. In an exemplary embodiment as shown in FIGS. 1, 3, 5 and 6, the exterior channel 98 is located on a front side or back side surface of the wrap element 44.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. An apparatus configured to be used with a sign mounted on an elongated post having a longitudinal orientation, the apparatus including identical first and second frame sections, each of the first and second frame sections including:

a first fastening element located at a first end thereof;

a second fastening element located at a second end thereof; and a first recess on a rear surface between the first and second ends configured to accommodate the post;

wherein the first fastening element of the first frame section is configured to cooperate with the second fastening element of the second frame section; and wherein the first fastening element of the second frame section is configured to cooperate with the second fastening element of the first frame section;

so that the identical first and second frame sections are configured to be fastened together to surround a perimeter edge of the sign; and the first recess of each of the first and second frame sections is configured to be positioned adjacent the post.

2. The apparatus of claim 1 wherein each of the first and second frame sections includes first and second substantially parallel legs joined by an intermediate leg.

3. The apparatus of claim 2 wherein:

the first end is located on the first leg; and the second end is located on the second leg.

4. The apparatus of claim 2 wherein at least one of the first and second substantially parallel legs is configured to be oriented substantially parallel to the longitudinal orientation of the post.

5. The apparatus of claim 2 wherein at least one of the first and second substantially parallel legs is configured to be oriented substantially perpendicular to the longitudinal orientation of the post.

6. The apparatus of claim 1 wherein the first fastening element is a male connector and the second fastening element is a female connector.

7. The apparatus of claim 6, wherein the female connector includes a bore and a channel in communication with the bore.

8. The apparatus of claim 7, wherein the female connector includes a shoulder adjacent the channel.

9. The apparatus of claim 8, wherein the male connector includes a protrusion configured to fit into the channel and engage the shoulder.

10. The apparatus of claim 1 wherein the first fastening element and the second fastening element are configured to snap together.

11. The apparatus of claim 1 further including a wrap element configured to surround the first and second frame sections.

12. The apparatus of claim 11 wherein the wrap element is formed as a single unitary piece.

13. The apparatus of claim 11 wherein the wrap element includes a resilient, compressible material.

14. The apparatus of claim 11 wherein the wrap element includes a second recess configured to be positioned adjacent the post.

15. The apparatus of claim 11 wherein the wrap element includes an interior channel configured to engage with perimeter surfaces of both of the first and second frame sections.

16. The apparatus of claim 15 wherein the perimeter surfaces of both of the first and second frame sections include a ridge.

17. The apparatus of claim 16 wherein the interior channel includes a groove having a contour that complements and engages the ridge.

18. The apparatus of claim 11 wherein the wrap element includes an exterior channel.

19. The apparatus of claim 18 wherein the exterior channel is located on a perimeter surface of the wrap element.

20. The apparatus of claim 18 wherein the exterior channel is located on a front or back surface of the wrap element.

* * * * *